US005888595A

United States Patent [19]

Krattiger

[11] Patent Number: 5,888,595

[45] Date of Patent: Mar. 30, 1999

[54] FLEXIBLE DECORATIVE ARTICLE

[76] Inventor: Kenneth L. Krattiger, 2612 Methil Dr., Birchwood, Wis. 54817

[21] Appl. No.: 944,640

[22] Filed: Oct. 6, 1997

Related U.S. Application Data

[63] Continuation-in-part of Ser. No. 66,827, Feb. 25, 1997, Pat. No. Des. 392,327.

[51] Int. Cl.[6] ..... G09F 1/08

[52] U.S. Cl. ..... 428/12; 40/124.08; 446/148

[58] Field of Search ..... 428/13, 7, 12; 40/124.08; 446/148

[56] References Cited

U.S. PATENT DOCUMENTS

| | | | |
|---|---|---|---|
| 4,295,187 | 10/1981 | Shemitz | 428/13 X |
| 4,723,745 | 2/1988 | Conway | 248/205.3 |
| 4,874,356 | 10/1989 | Volkert | 428/13 X |
| 5,157,852 | 10/1992 | Patrov et al. | 428/13 X |
| 5,294,279 | 3/1994 | Kuhns et al. | 428/13 X |

OTHER PUBLICATIONS

Ideaworks, LLC, Glendale, CA, (Undated), Four photocopy papers appearing to show a magnetic article.

Fasteners For Retail, Inc., Cleveland, OH, (Undated), Two photocopy papers apparently showing an advertisment for a flexible display holder.

Ideaworks, LLC, (Undated), Two photocopy papers apparently showing an advertisment for the Wiqqlits© Theater.

Penguin Books USA, Inc., New York, NY (Copyright Date 1997). One color photocopy containing two photographs of a Wigglits© Theater book.

*Primary Examiner*—Henry F. Epstein

*Attorney, Agent, or Firm*—Skinner and Associates

[57] ABSTRACT

A decorative article for displaying themes that may be used in decorating, educating, or advertising. The decorative article comprises a base, one or more frontal portions, and one or more flexible branch elements connecting each of the frontal portions to the base. The branch elements suspend the frontal elements in front of the base. Air current or other motion attributed to external forces can induce the frontal elements into a random bouncing motion on the branch elements. The base and the frontal portions have predetermined shapes and are imprinted with predetermined graphical designs. The base, frontal portions and branch elements are created from thin, flexible and preferably transparent plastic material which make the graphical designs viewable from multiple directions.

19 Claims, 12 Drawing Sheets

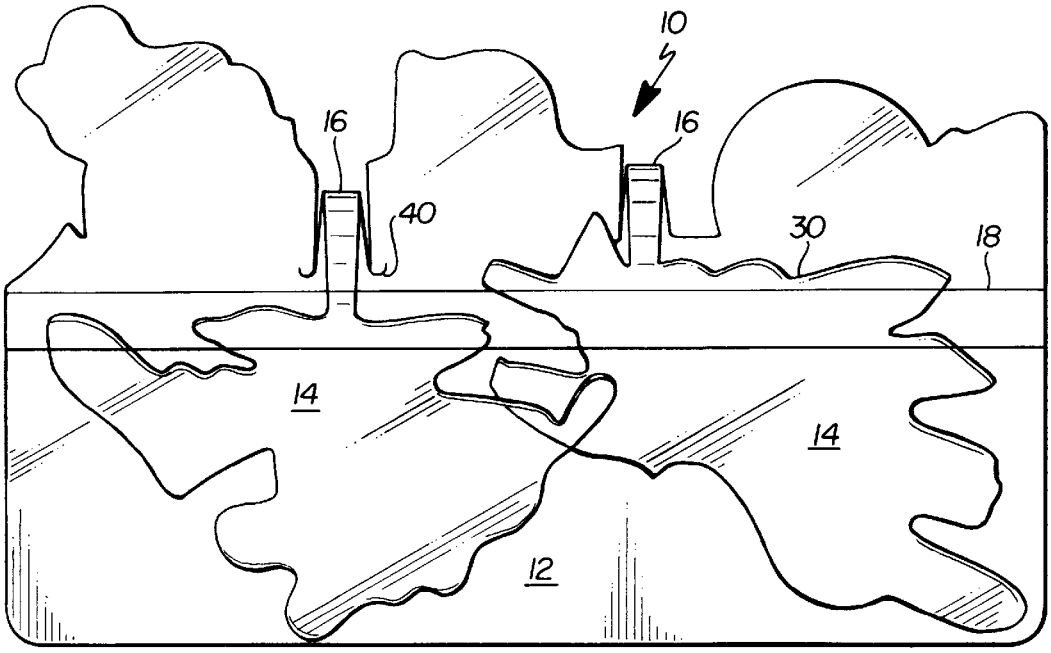
Fig.8
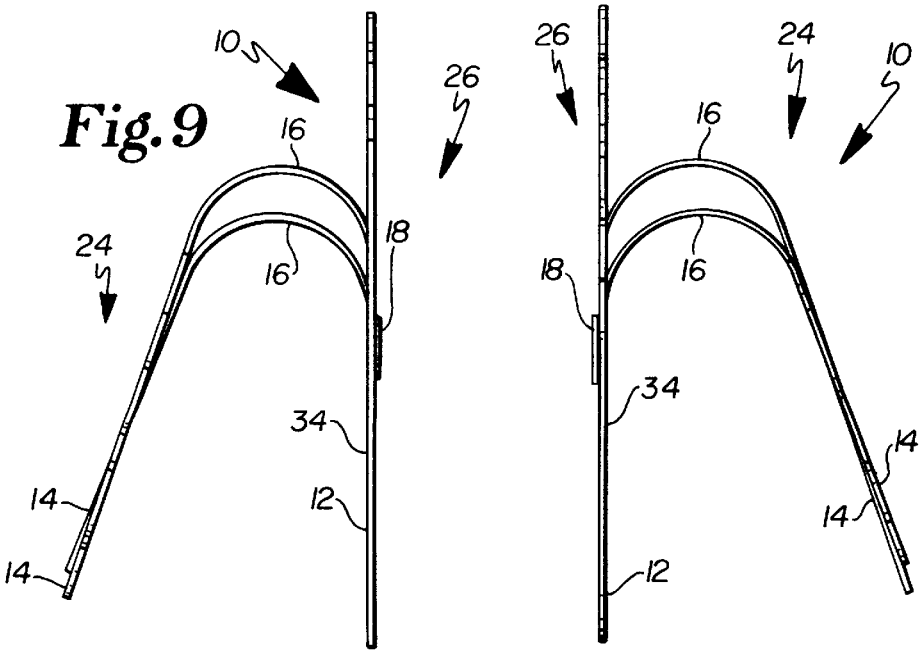
Fig.9
Fig.10

FLEXIBLE DECORATIVE ARTICLE

CROSS-REFERENCE TO RELATED APPLICATIONS

This is a continuation-in-part of application Ser. No. 29/066,827, filed on Feb. 25, 1997 now U.S. Pat. No. D392,327.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention relates, generally, to ornamental articles. More particularly, the invention relates to flexible articles used for advertising, educational, or decorative purposes. The invention has particular utility used as a decoration, display, or advertisement adhered to a smooth surface, especially a glass window or door. However, the invention also may have utility in other applications.

2. Background Information

In the past, various devices have been used as decorations. The known art includes posters, signs, clings, mobiles and point-of-purchase danglers. However, these devices and methods have significant limitations and shortcomings. Specifically, posters, signs and clings are static, two-dimensional graphical articles whose subjects cannot dynamically interrelate either with each other or with a background scene. Furthermore, although two-sided clings are capable of being displayed in two directions, the images of posters and signs are only capable of being displayed in one direction when attached to a smooth, transparent surface such as a glass door or window. Danglers, also known as shelf-talkers, and three-dimensional mobiles also fail to provide subjects that dynamically interrelate with other subjects or with a background scene.

Despite the need in the art for a decorative article which overcomes the disadvantages, shortcomings and limitations of the prior art, none insofar as is known has been developed. Accordingly, it is an object of the present invention to provide an improved decorative article which is three-dimensional and aesthetically pleasing from the front and rear. It is a further object of this invention to provide a decorative article that has both a background scene and a foreground, wherein the subjects of the foreground dynamically interrelate with each other and with the subjects and imagery of the background scene in a predetermined arrangement. Additionally, it is an object of this invention to provide a decorative article that is easily manufactured, packaged, distributed, displayed, removed, stored, and re-displayed.

BRIEF SUMMARY OF THE INVENTION

The present invention provides a decorative article which comprises a base and at least one frontal portion attached to the base by at least one branch element. The branch element extends and suspends the frontal portion in front of the base. The base, frontal portion(s) and branch element(s) are constructed from thin, flexible, and preferably clear, plastic material. An adhesive is applied to the back of the base and is used to mount the decorative apparatus to smooth surfaces such as windows, doors, and file cabinets. The adhesive has characteristics that allow the decorative apparatus to be repeatedly displayed and removed. There are numerous structural embodiments of the present invention, including various shapes of the base, branch elements and frontal portions, various numbers of frontal portions, and various numbers of branch elements attached to any individual frontal portion. The branch element may be an angular branch element configured to laterally extend the frontal portion at a variety of angles from the base and suspend the frontal portion at a variety of non-planar angles with respect to the base. In addition, various artwork, graphical designs, and subjects pertaining to seasonal, holiday, educational, all occasion, licensed merchandise, and similar themes are imprinted on the base and the frontal portion. If the decorative article is constructed from clear plastic, the artwork can be viewed from both the front and rear of the decorative article. Thus, the decorative article is well-suited for displaying themes on transparent, smooth surfaces such as windows and glass doors, although it can be displayed on most any smooth surface. Furthermore, each frontal portion extends forward at a predetermined angle and suspends from the base by one or more flexible branch elements in a predetermined arrangement with any other frontal portions and the base. Each frontal portion can be influenced by air current, or other movement, to have a random motion with respect to each other and to the base. The eye-catching random motion and three-dimensional depth enhance the imagery and dynamically interrelate the subjects of the frontal portion with the subjects of other frontal portions and with the subjects and background of the base. The decorative article is designed to be easily manufactured, packaged, distributed, displayed, removed, stored and redisplayed repeatedly.

The features, benefits and objects of this invention will become clear to those skilled in the art by reference to the following description, claims and drawings.

BRIEF DESCRIPTION OF THE SEVERAL VIEWS OF THE DRAWING

FIG. 8 is a front view of the decorative article of FIG. 7.

FIG. 9 is a side view of the decorative article of FIG. 7.

FIG. 10 is an opposite side view of the decorative article of FIG. 7.

DETAILED DESCRIPTION

Examples of preferred embodiments of the present invention are illustrated in FIGS. 1–6, 7–13, 14, 15, 16, 17 and 18–19. The decorative article 10 as shown in the embodiments is generally described below first in terms of its major structural elements and then in terms of its secondary structural and functional elements.

Figure 1:
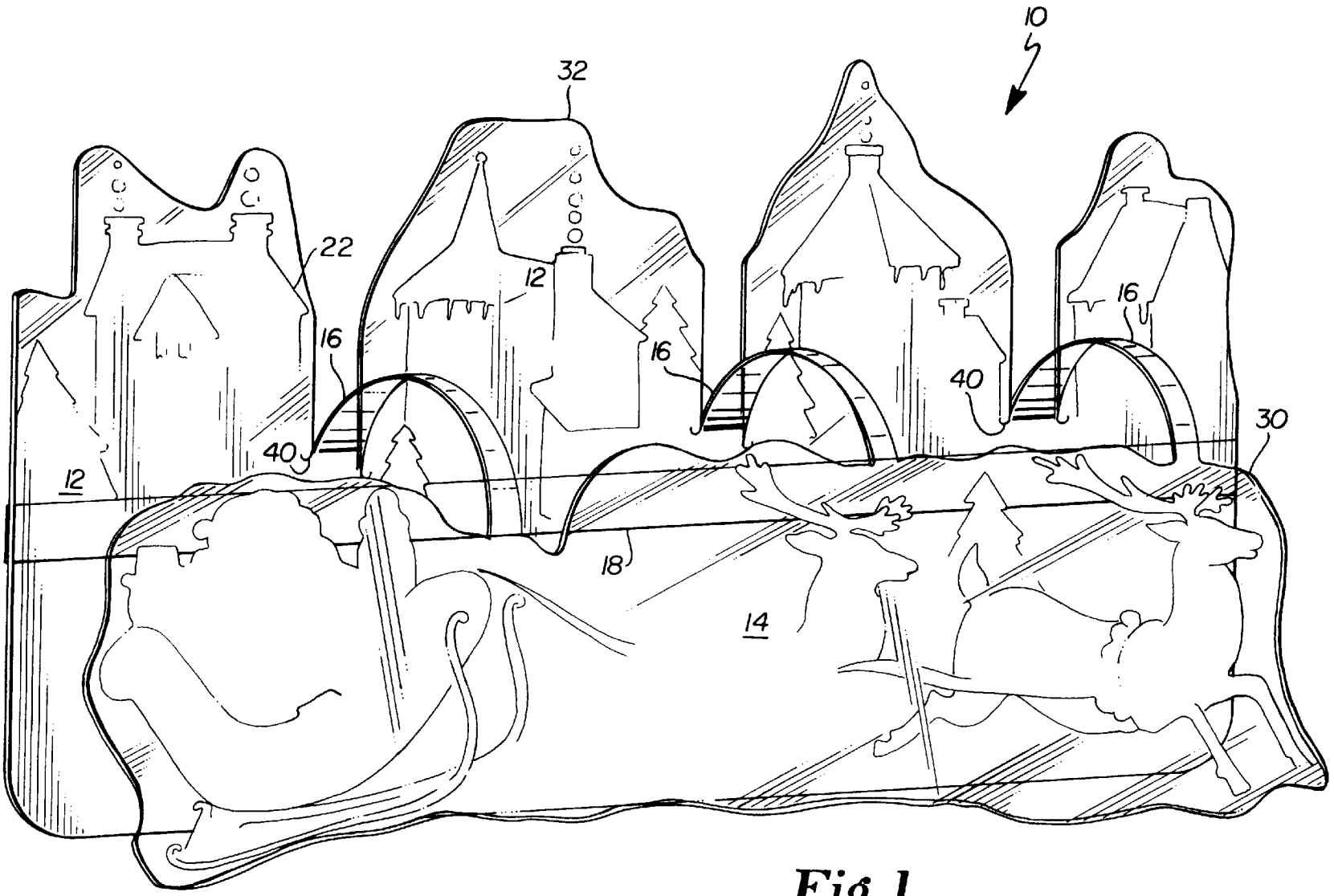
FIG. 1 is a perspective view of an embodiment of the decorative article.
Figure 2:
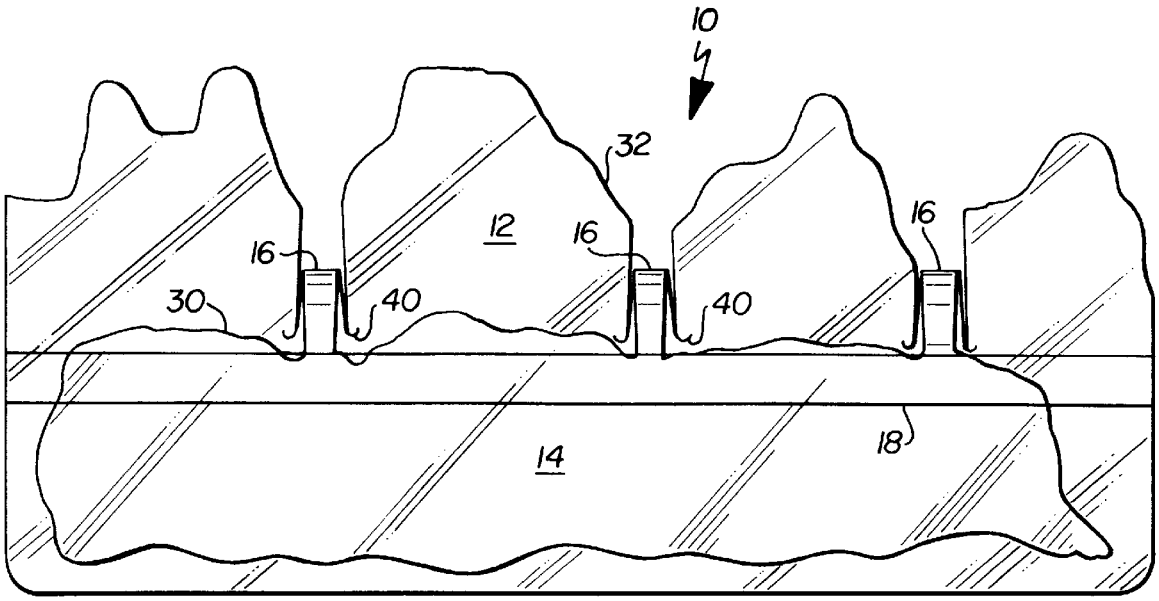
FIG. 2 is a front view of the decorative article of FIG. 1.
Figure 3:
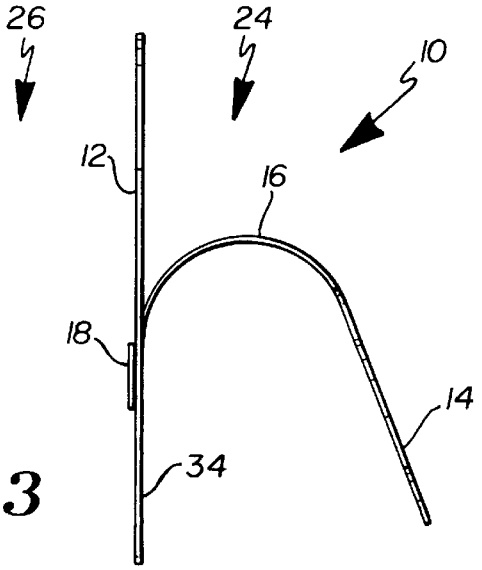
FIG. 3 is a side view of the decorative article of FIG. 1.
Figure 4:
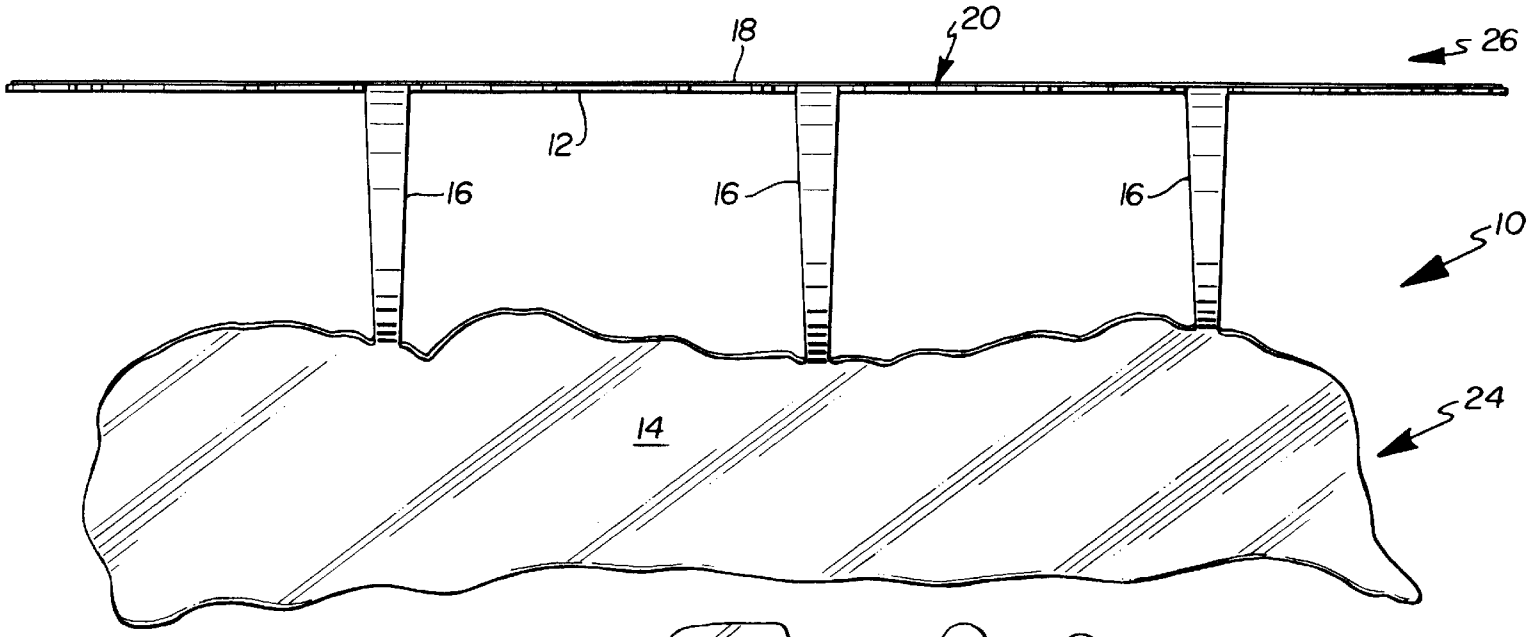
FIG. 4 is a top view of the decorative article of FIG. 1.
Figure 5:
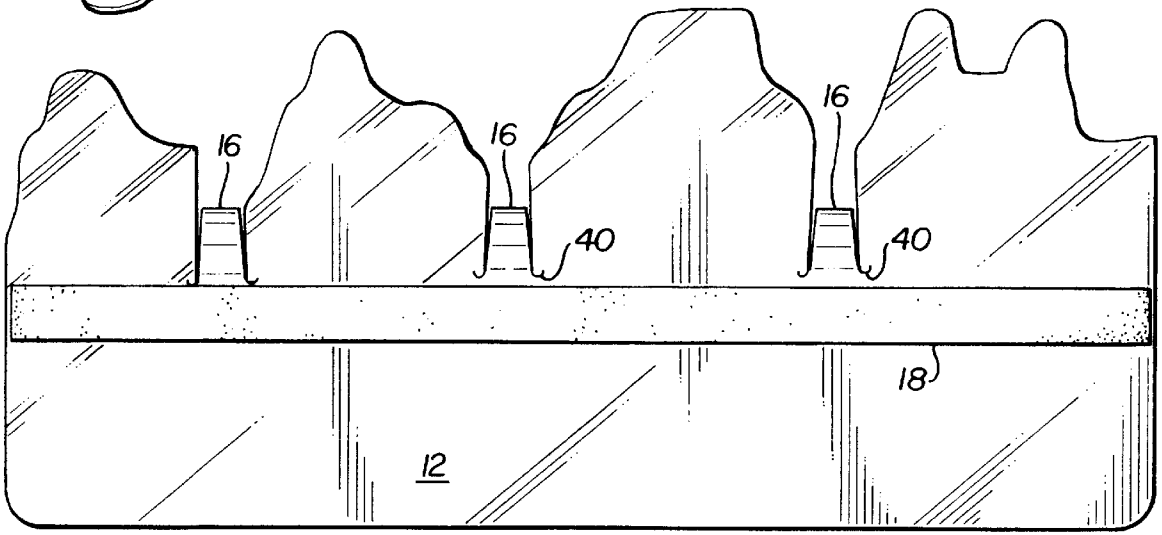
FIG. 5 is a back view of the decorative article of FIG. 1.
Figure 7:
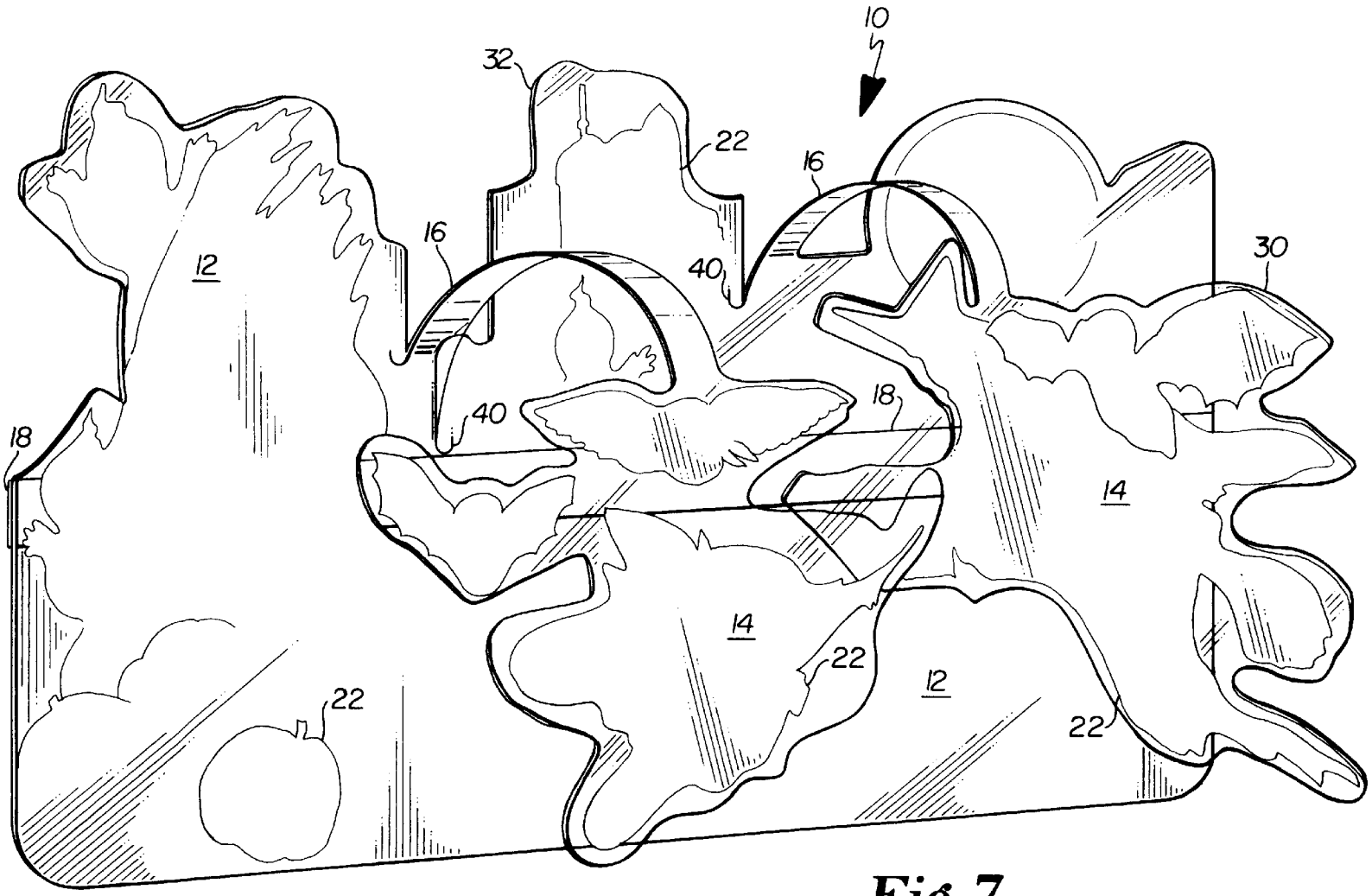
FIG. 7 is a perspective view of second embodiment of the decorative article.
Figure 11:
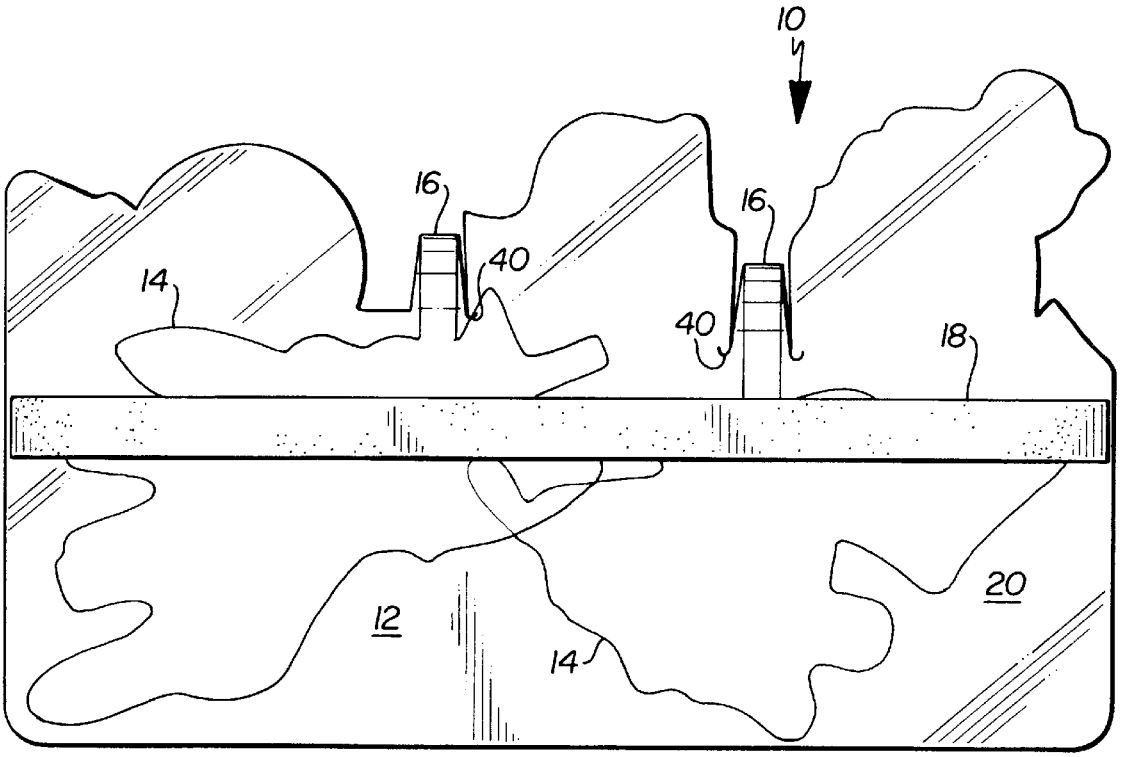
FIG. 11 is a back view of the decorative article of FIG. 7.
Figure 12:
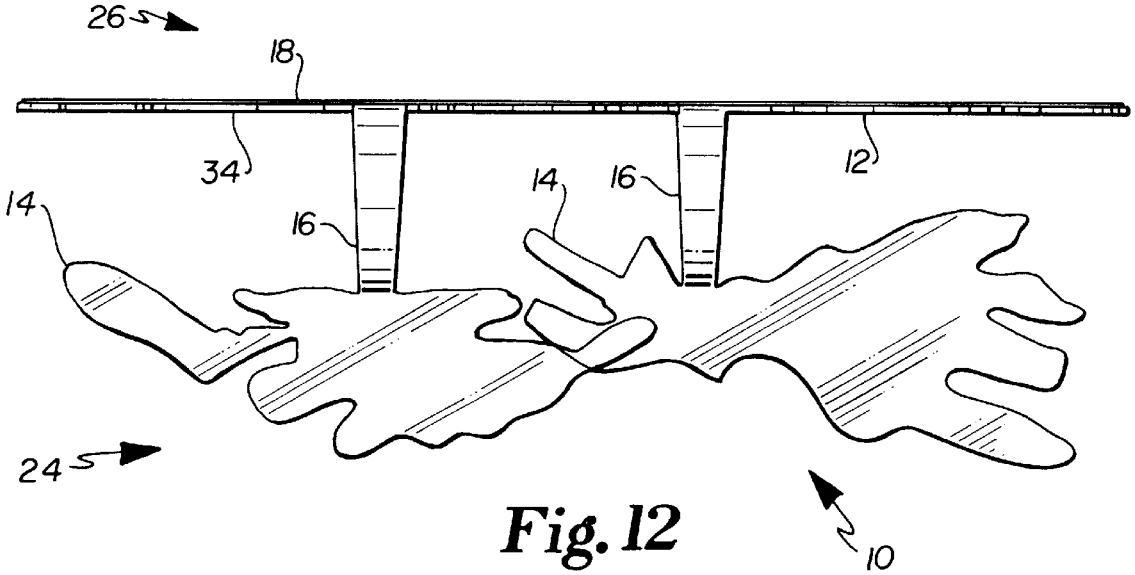
FIG. 12 is a top view of the decorative article of FIG. 7.
Figure 19:
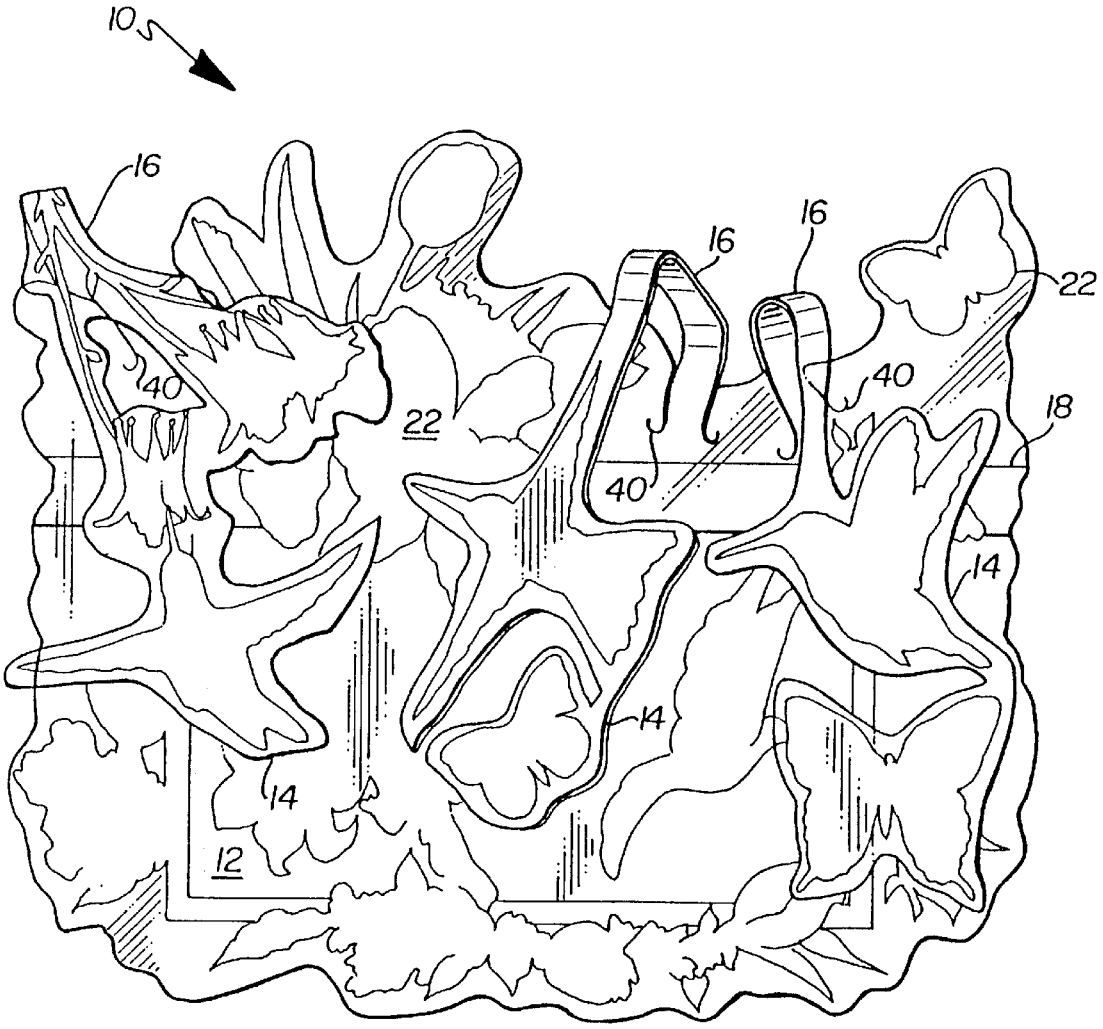
FIG. 19 is a front view of the seventh embodiment of the decorative article.

Referring to the perspective views of FIGS. 1, 7 and 19 and the front views of FIGS. 14–17, the major elements incorporated in all embodiments of the decorative article 10 include a base 12, at least one frontal portion 14, and at least one branch element 16 connecting each frontal portion 14 to the base 12. The frontal portion 14 extends in front of the base 12 and hangs or suspends from the branch element 16. A high/low tack adhesive strip 18, shown in FIGS. 5 and 11, tightly adheres to the back 20 of the base 12 and lightly adheres to a smooth surface such as a window, door, or filing cabinet. The characteristics of the adhesive strip 18 allow the decorative article 10 to be repeatedly applied to a surface and removed without damaging the decorative article 10 or surface. The strip 18 has a liner (not shown) that is removed from the strip when the decorative article is hung for display and can be applied onto the strip when the decorative article is stored. Although the embodiments illustrated in the figures show the base 12 as a flat sheet that is applied to a relatively vertical surface, it is anticipated that the design of the base 12 could be altered to form a stand that would allow the article to set on top of a flat surface as a free-standing display or to be attached on top of the surface.

The base 12, frontal portion 14, and branch element 16 are constructed from thin, flexible and preferably clear plastic. Artwork or graphical images 22 are UV printed on both the base 12 and the frontal portion 14. This artwork 22 is visible from the front 24 and rear 26 of the decorative article 10. Back lighting, such as sunlight through a window, enhances the colors and imagery of any translucent artwork 22.

Figure 6:
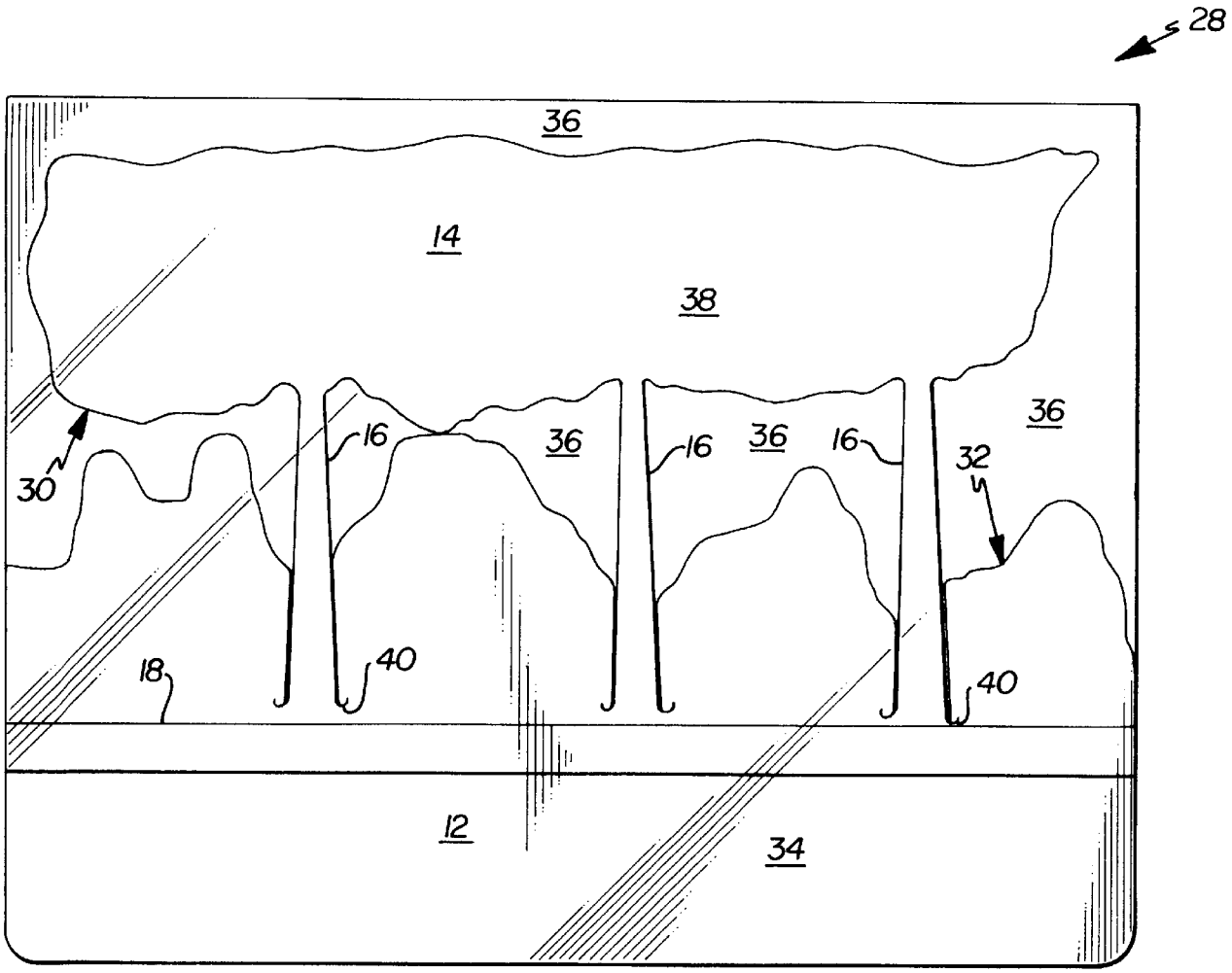
FIG. 6 is a front view of a sheet of plastic cut to form the decorative article of FIG. 1.
Figure 13:
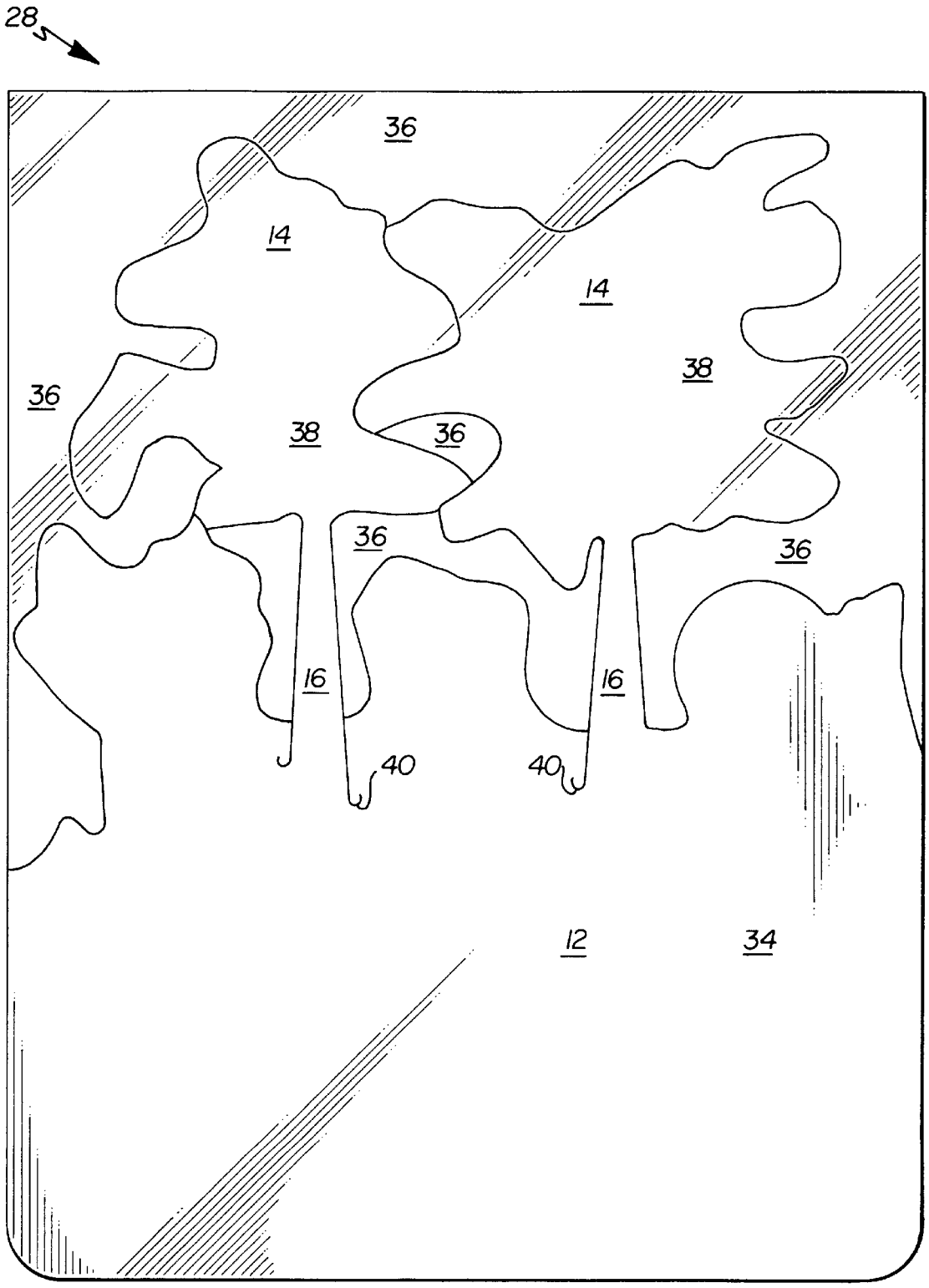
FIG. 13 is a front view of a sheet of plastic cut to form the decorative article of FIG. 7.
Figure 14:
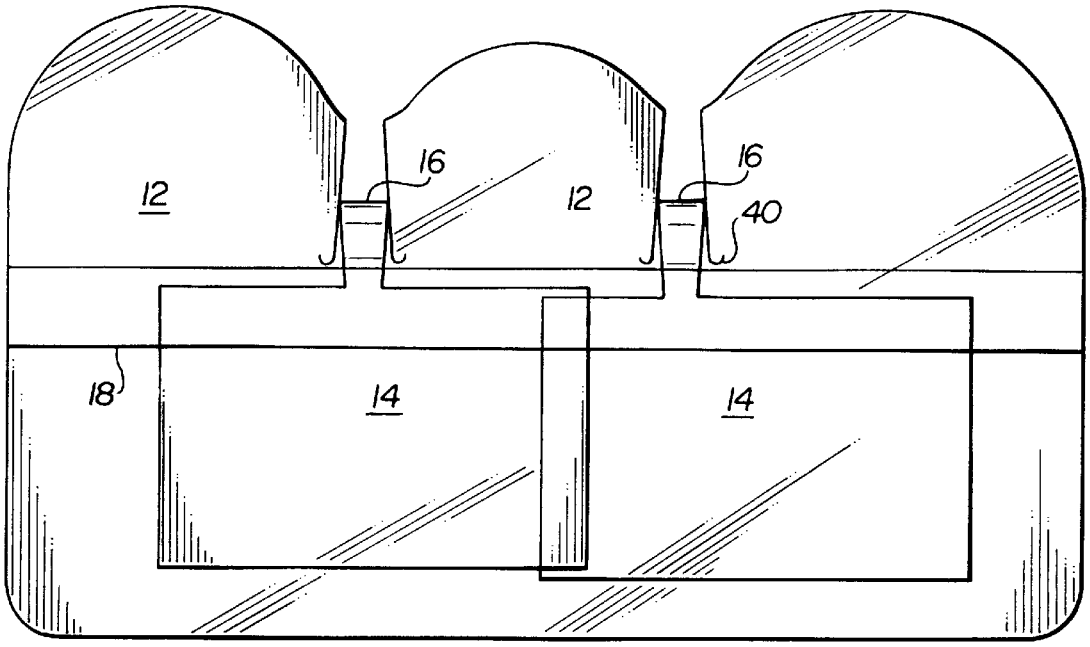
FIG. 14 is a front view of a third embodiment of the decorative article.
Figure 15:
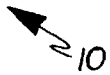
FIG. 15 is a front view of a fourth embodiment of the decorative article.
Figure 15:
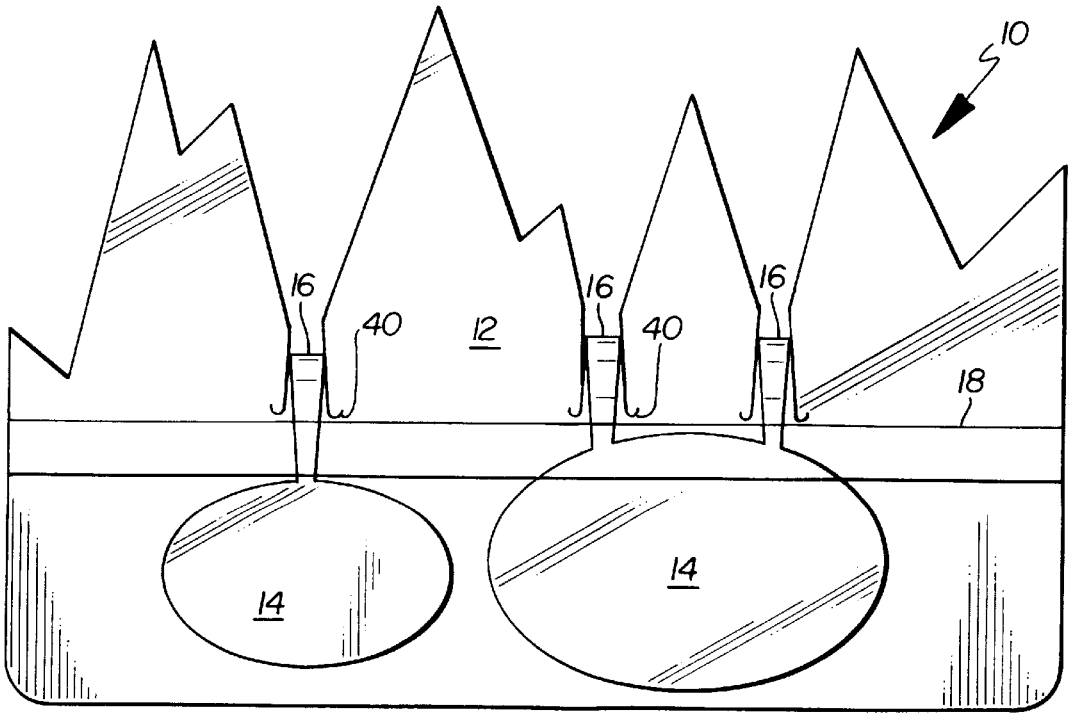
Figure 16:
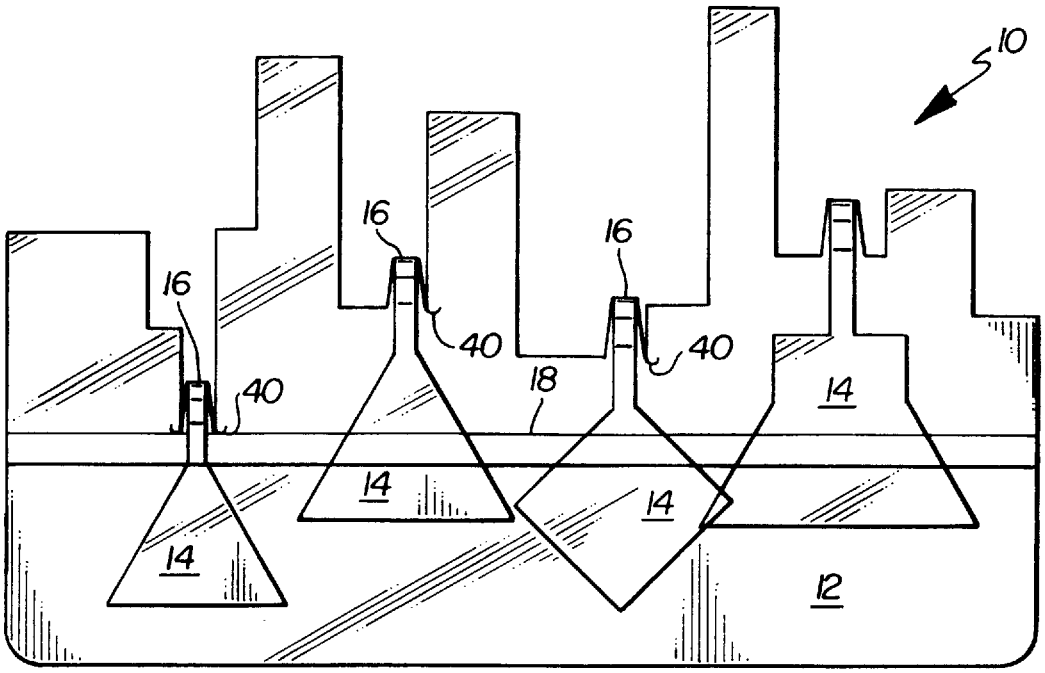
FIG. 16 is a front view of a fifth embodiment of the decorative article.
Figure 17:
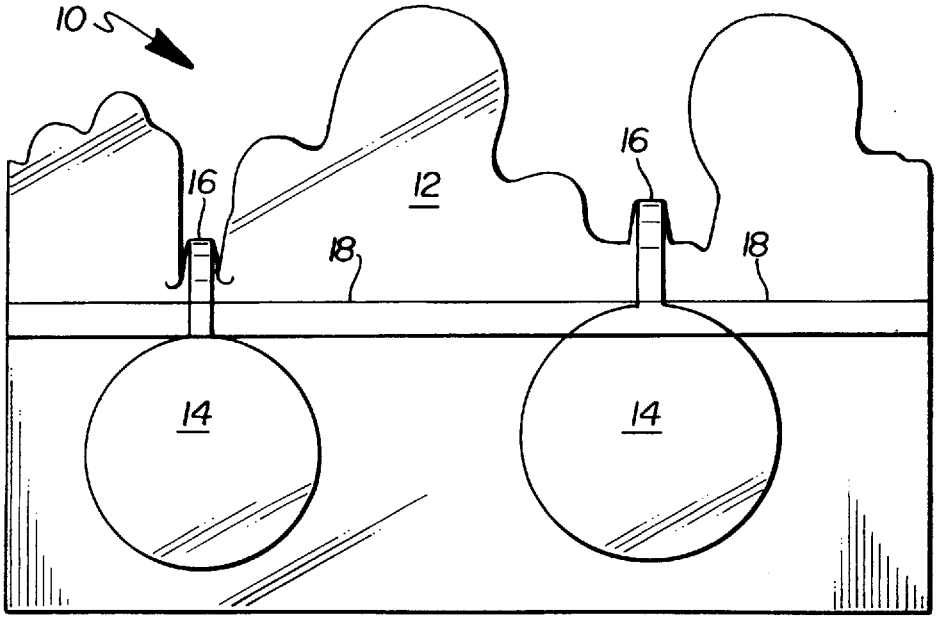
FIG. 17 is a front view of a sixth embodiment of the decorative article.
Figure 18:
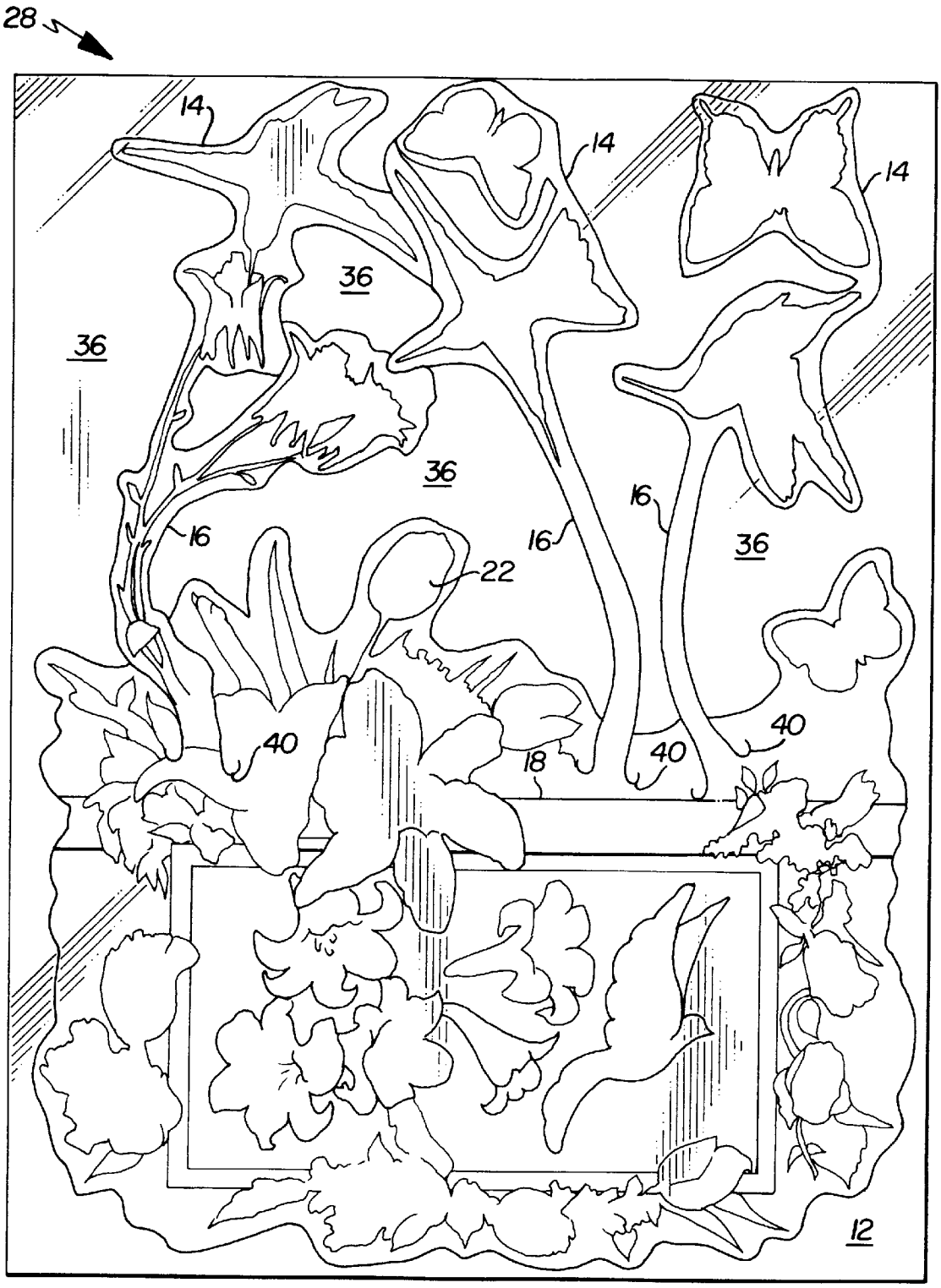
FIG. 18 is a front view of a sheet of plastic cut to form a seventh embodiment of a decorative article.

The base 12, the frontal portion(s) 14, and the branch element(s) 16 of a decorative article 10 are preferably constructed as a unitary structure. As shown in FIGS. 6, 13 and 18, the base 12, the frontal portion 14, and the branch element 16 are formed from a relatively rectangular sheet of plastic 28. The top 30 of each frontal portion 14 within the sheet of plastic 28 is oriented to be adjacent to the top 32 of the base 12. The back 38 of each frontal portion 14 and the front 34 of the base 12 are formed from the same surface of the sheet of plastic. Branch elements 16 extend between the top 32 of the base 12 and the top 30 of the frontal portion 14. The characteristics of the plastic used within the decorative article 10 and specifically within the branch elements 16 cause the branch element 16 of a displayed decorative article 10 to extend upward from the base 12, arc forward, and suspend the frontal portion 14 proximate to the front 34 of the base 12. The branch element 16 has a stiffness and elasticity that causes the frontal portion 14 to randomly move or bounce in reaction to air current or other external forces and to return the frontal portion 14 to the desired resting position upon the removal of the external force. The artwork 22 and shape of both the frontal portion 14 and base 12 are designed to account for and use this motion to enhance the imagery in the decorative article 10 by dynamically interacting or interrelating the subjects on the frontal portion 14 with the subjects and/or background scene on the base 12.

The decorative article 10 is designed to be easily and economically manufactured, packaged, delivered and displayed. The decorative article 10 is manufactured by UV printing artwork 22 on stock sheets of plastic, applying adhesive 18 to the back of the decorative article 10, and cutting the shape of the decorative article 10 in the plastic. The depth of the cut perforates the plastic and allows each decorative article 10 to be manually removed from the plastic. The plastic is cut into rectangular sheets 28. Each sheet 28 is packaged and distributed with the decorative article 10 contained within the sheet 28. The decorative article 10 is displayed by removing the remnants 36 of the sheet 28 from the decorative article 10, removing the backing or liner from the adhesive 18, and adhering the base 12 of the decorative article 10 to a relatively smooth surface. The frontal portion 14 arcs over and suspends proximate to the front 34 of the base 12. The decorative article 10 can be removed and stored as a flat sheet, and redisplayed at a later time.

The junction of each branch element 16 with the base 12 preferably includes anti-tear cuts 40 or notches. These anti-tear cuts 40 prevent the weight of the frontal portions 14 from shearing or tearing the plastic between the branch element 16 and the base 12. The shearing force follows the anti-tear cut 40 rather than tearing the base 12. The anti-tear cut 40 is preferably u-shaped, with one side of the u-shaped cut following the line of the branch element 16 and the other side extending into the base 12. The distance between the sides of the u-shaped anti-tear cut 40 is about ⅛ inch in the preferred embodiment.

The decorative article 10 is designed to be used for multiple purposes, including decorating, educating, and advertising. The decorative article 10 can display a variety of themes or subjects such as educational topics, licensed merchandise, or seasonal, holiday, or all purpose themes by imprinting various artwork 22, graphical images, and/or subjects. For example, FIGS. 1–6 show a Santa Claus and sleigh displayed on a single frontal portion 14. The sleigh is suspended in front of a background scene of a winter village displayed on the base 12. FIGS. 7–13 show a Halloween theme with a witch on a broom displayed on one frontal portion 14 and a cat on a broom displayed on another frontal portion 14. The cat and witch are suspended in front of a background scene that includes a caldron, various spirits or ghosts, and a skeleton. In the above embodiments, the motion of the sleigh, the cat, and the witch causes the appearance that they are in flight with respect to the background images. In both displays, the transparent plastic, the translucent and colorful images, the random motion and dimensional depth created by the frontal portions 14 enhance the entire theme illustrated on the decorative article 10. FIGS. 14, 15, 16, and 17 illustrate other combinations of shapes and numbers of frontal portions 14. FIGS. 18–19 show a floral scene with hummingbirds, butterflies and flower stems displayed on the frontal portions 14. These frontal portions 14 are suspended in front of a background scene of flora and are arranged so that the hummingbirds and butterflies appear to float among the flower buds. The angular branch elements allow the frontal portions to laterally extend across the background scene. Furthermore, the angular branch elements can cause the frontal portions to skew or hang at a non-planar angle with respect to the base. As a result, the hummingbirds appear to fly either toward or away from the flowers.

The shape of the decorative article 10 and the layout of the artwork 22 result from a design planning process that generally includes the steps of: planning the general theme for the article; establishing the subject matter and the number, size, shape and placement of the frontal portions 14, including the desired number of branch elements 16 for each frontal portion 14; establishing the background activity areas on the base 12 such that most of the active background artwork 22 will be viewable from the front 24 of the decorative article 24; establishing the background subjects of the base 12 and their relation to the rest of the background scene and the subjects of the frontal portion 14; establishing the shape of the base to complement the background; establishing the desired resting point of each frontal portion 14 in relation to the background artwork 22; and interrelating the motion of the frontal portion 14 to the background scene of the base 12.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

What is claimed is:

1. A decorative article having a front and a rear, comprising:

(a) a base of a predetermined shape imprinted with a predetermined graphical design, said base having a top, a back, and a front;

(b) at least one frontal portion of a predetermined shape imprinted with a predetermined graphical design, said frontal portion having a top, a back, and a front;

(c) at least one branch element connecting each of said frontal portions to said base, said branch element flexibly suspending said frontal portion from said top of said base proximate to said front of said base, said back of said frontal portion facing said front of said base portion; and (d) said base, said frontal portion, and said branch element being constructed from a thin, flexible and transparent plastic material, said graphical designs of said base and said frontal portion being visible from said front and said rear of said decorative article.

2. The decorative article of claim 1, wherein said graphical designs are translucent.

3. The decorative article of claim 2, wherein said graphical designs are UV printed on said plastic material.

4. The decorative article of claim 1, wherein said frontal portion is positioned and said graphical designs on said frontal portion and said base are arranged to interrelate through movement of said frontal portion with respect to said base.

5. The decorative article of claim 1, wherein an adhesive is applied to said back of said base, said adhesive allowing said base to be adhered to a smooth surface.

6. The decorative article of claim 5, wherein said base is adapted for adhesion to a generally vertical surface.

7. The decorative article of claim 1, wherein said base, said frontal portion, and said branch element form a unitary structure.

8. The decorative article of claim 7, wherein said base, said frontal portion, and said branch element are constructed from a sheet of thin plastic material, said sheet having a front surface and a rear surface.

9. The decorative article of claim 8, wherein an anti-tear cut is formed at a junction between said base and said branch element.

10. The decorative article of claim 8, wherein (a) said front of said base is formed from said front surface and said back of said base is formed from said rear surface;

(b) said front of said frontal element is formed from said rear surface and said back of said frontal portion is formed from said front surface; and (c) said branch element is formed by a strip of said plastic material between said top of said front portion and said top of said base.

11. The decorative article of claim 10, wherein said sheet is cut to form said predetermined shape of said base, said predetermined shape of said frontal portion, and said branch element, said top of said frontal portion being oriented to be adjacent to said top of said base within said sheet.

12. The decorative article of claim 11, wherein said sheet is cut to form perforations that outline the shape of said base, said frontal portion, and said branch element, and wherein said decorative article is packaged and distributed within said sheet and is displayed after being manually removed from said sheet.

13. The decorative article of claim 1, wherein said branch element is an angular branch element, said angular branch element laterally extending said frontal portion across said base and suspending said frontal portion at a non-planar angle with respect to said base.

14. A flexible decorative article, comprising:

(a) a base of a predetermined shape imprinted with a predetermined graphical design, said base portion having a top, a back, and a front, said base being constructed from clear, flexible plastic;

(b) at least one frontal portion of a predetermined shape imprinted with a predetermined graphical design, said frontal portion having a top, a back, and a front, said frontal portion being constructed from clear, flexible plastic;

(c) at least one branch element connecting each of said at least one frontal portion to said base, said branch element flexibly suspending said frontal portion from said top of said base proximate to said front of said base, said branch element being constructed from clear, flexible plastic; and (d) an adhesive applied to said back of said base, wherein said decorative article has a front and a rear, and wherein said graphical design of said base and said frontal portion is viewable from said front and said rear of said decorative article, wherein said decorative article is displayed by adhering said back of said base to a surface allowing said branch element to extend from said top of said base, arc forward, and flexibly suspend said frontal portion proximate to said front of said base.

15. A flexible, thin decorative article including artwork, graphical designs, or subjects pertaining to seasonal, holiday, educational, all occasions, advertising, or licensed merchandise, and for connection to a generally transparent, vertical surface, comprising:

(a) a base of a predetermined shape imprinted with a predetermined graphical design, said base portion having a top, a back, and a front;

(b) at least one frontal portion of a predetermined shape imprinted with a predetermined graphical design, said frontal portion having a top;

(c) at least one branch element connecting each of said frontal portions to said base, (d) said branch element flexibly suspending said frontal portion from said top of said base proximate to said front of said base; and (e) an adhesive applied to said back of said base, wherein said base, said frontal portion, and said branch element form a continuous unitary structure constructed from a sheet of flexible, clear plastic material, said sheet being cut to form perforations that outline said predetermined shape of said base, said predetermined shape of said frontal portion, and said branch element connecting said top of said base to said top of said frontal portion, said decorative article capable of being manually removed from said sheet, wherein said decorative article has a front and a rear, and wherein said graphical designs of said base and said frontal portion are viewable from said front and said rear of said decorative article, wherein, when said base is adhered to a relatively vertical surface, said branch element extends from said top of said base, arcs forward, and suspends said frontal portion proximate to said front of said base, and whereby said frontal portion has a predetermined resting position and has a tendency to randomly bounce on said branch element when induced by external forces.

16. A decorative article having a front and rear, comprising:

(a) a base of a predetermined shape imprinted with a predetermined graphical design, said base having a top, a back, and a front, said base being constructed from a clear, flexible plastic;

(b) at least one frontal portion of a predetermined shape imprinted with a predetermined graphical design, said frontal portion having a top, a back, and a front, said frontal portion being constructed from a clear, flexible plastic;

(c) at least one branch element connecting each of said frontal portions to said base, said branch element flexibly suspending said frontal portion from said top of said base proximate to said front of said base, said back of said frontal portion facing said front of said base portion, said branch element being constructed from a clear, flexible plastic;

(d) said graphical designs of said base and said frontal portion being visible from said front and said rear of said decorative article;

(e) said frontal portion being suspended in a predetermined position, said graphical design on said frontal portion and said graphical design on said base being arranged to interrelate, said graphical design of said frontal portion moving with respect to said graphical design of said base when an external force induces movement in said frontal portion; and (f) said base, said frontal portion and said branch element forming a continuous, unitary structure, said base, said frontal portion and said branch element being cut from a sheet of clear, flexible plastic material.

17. The decorative article of claim 16, wherein said back of said base has an adhesive allowing said base to be adhered to a smooth surface, said base and said branch element forming a junction, said junction having an anti-tear cut to prevent said suspended frontal element from tearing a rip into said base.

18. The decorative article of claim 16, wherein said sheet of clear, flexible plastic material has a front surface and a rear surface, said front of said base being formed from said front surface and said back of said base being formed from said rear surface, said front of said frontal element being formed from said rear surface and said back of said frontal portion being formed from said front surface, said branch element being formed by a strip of said plastic material between said top of said front portion and said top of said base, said sheet being cut to form perforations that outline the shape of said base, said frontal portion, and said branch element, said top of said frontal portion being oriented to be adjacent to said top of said base within said sheet, said decorative article being packaged and distributed within said sheet and being displayed after being manually removed from said sheet.

19. A decorative article, comprising:

(a) a base of a predetermined shape imprinted with a predetermined graphical design, said base having a top, a back, and a front;

(b) at least one frontal portion of a predetermined shape imprinted with a predetermined graphical design, said frontal portion having a top, a back, and a front;

(c) at least one branch element connecting each of said frontal portions to said base, said branch element flexibly suspending said frontal portion from said top of said base proximate to said front of said base, said back of said frontal portion facing said front of said base portion; and (d) said base, said frontal portion, and said branch element forming a continuous, unitary structure constructed from a sheet of thin plastic material.

* * * * *